United States Patent [19]

Takeuchi

[11] 4,127,050

[45] Nov. 28, 1978

[54] BRASS WIND MUSICAL INSTRUMENT

[75] Inventor: Akihiko Takeuchi, Hamamatsu, Japan

[73] Assignee: Nippon Gakki Seizo Kabushiki Kaisha, Hamamatsu, Japan

[21] Appl. No.: 859,562

[22] Filed: Dec. 12, 1977

[30] Foreign Application Priority Data

Dec. 22, 1976 [JP] Japan ..... 51-153320
Dec. 22, 1976 [JP] Japan ..... 51-153321

[51] Int. Cl.[2] ..... G10D 7/10
[52] U.S. Cl. ..... 84/387; 84/388
[58] Field of Search ..... 84/387, 388, 389, 390, 84/391, 392, 393, 394

[56] References Cited

U.S. PATENT DOCUMENTS 3,886,837 6/1975 Veneklasen ..... 84/388

*Primary Examiner*—L.T. Hix
*Assistant Examiner*—S. D. Schreyer
*Attorney, Agent, or Firm*—Flynn & Frishauf

[57] ABSTRACT

A brass wind musical instrument comprises two main tubes along which a plurality of bypasses are arranged, the bypasses being inserted in series into the corresponding main tubes by the action of valve assemblies; an intermediate tube; a first changeover valve, which, while remaining inoperative, effects communication between a mouthpiece and one end of one of the main tubes, as well as between one end of the other main tube and one end of the intermediate tube, and which, while being operated, ensures communication between the mouthpiece and said one end of the other main tubes, as well as between said one end of said one main tube and said one end of the intermediate tube; and a second changeover valve, which, while remaining inoperative, carries out communication between a bell and the other end of said one main tube, as well as between the other end of the other main tube and the other end of the intermediate tube, and, when operated, attains communication between the bell and the other end of the other main tube, as well as between the other end of said one main tube and the other end of the intermediate tube, and wherein the nonoperation, selective use and simultaneous operation of the two changeover valves enable the brass wind musical instrument to be played over a broad range of musical tones.

5 Claims, 10 Drawing Figures

BRASS WIND MUSICAL INSTRUMENT

BACKGROUND OF THE INVENTION

This invention relates to a brass wind musical instrument provided with a plurality of tubings and valve assemblies which selectively determine the effective length of air passages to make a performance with a broad range of musical tones.

The regular type of brass wind musical instrument, for example, a French horn which is operated by valve assemblies comprises a mouthpiece fitted to one end of said horn; a bell provided at the other end thereof; a main tube for defining a fundamental tone; bypasses (customarily referred to as crooks or loops) connected to the main tube; and valves, which, when operated, connect the corresponding bypasses to the main tube in series to extend the length of an air column formed in said main tube, thereby giving forth musical tones having the desired pitches.

With the above-mentioned type of brass wind musical instrument, a number of valve assemblies usable for a performance is generally limited to three to five in consideration of the operability of said instrument, presenting difficulties in fully broadening the range of musical tones being played.

The known so-called double type of brass wind musical instrument developed to eliminate the above-mentioned drawback comprises two main tubes and valve assemblies having a double construction, thereby enabling either of the main tubes to be selectively operated by the desired changeover valve. One of the main tubes having different lengths is named the B tube and the other thereof is referred to as the F tube. It is possible to form a brass wind musical instrument of three main tubes respectively acting as the B, F and G tubes. In this case, however, the resultant brass wind musical instrument would have a complicated construction due to application of valve assemblies having a triple construction, and an increased weight. Therefore, inconvenience or difficulties would be experienced in making a performance on such instrument. A brass wind musical instrument of quadruple or more complicated construction is no longer practicable.

Another known brass wind musical instrument referred to as a semi-double type comprises a main tube, another tube connected to a changeover valve, and valve assemblies of double construction selectively operable to change the effective length of the two tubes. With this type of brass wind musical instrument, the main tube is used with or without said another tube for a performance. Even this construction allows only B and F tubes to be selectively used by a changeover valve.

It is accordingly an object of this invention to provide a brass wind musical instrument enabling a performance to be made over a broader range of musical tones than has been possible in the past.

Another object of the invention is to provide a brass wind musical instrument of light weight and simple construction which can produce a broader range of musical tones than has been possible with the similar conventional musical instrument.

SUMMARY OF THE INVENTION

According to an aspect of this invention, there is provided a brass wind musical instrument which comprises a first main tube having a prescribed length; a second main tube having a prescribed length; a mouthpiece capable of being selectively connected to one end of the respective main tubes; a bell capable of being selectively connected to the other end of the respective main tubes; a first changeover valve which, while remaining inoperative, carries out communication between the mouthpiece and one end of the first main tube; a plurality of bypasses arranged along the respective main tubes; and valve assemblies which, when operated, insert the respective bypasses in series into the corresponding main tubes; said instrument further comprising an intermediate tube having a prescribed length; said first changeover valve further providing, while remaining inoperative, communication between the one end of the second main tube and one end of the intermediate tube, and, when operated, communication between the one end of the first main tube and the one end of the intermediate tube, as well as between the mouthpiece and the one end of the second main tube; and a second changeover valve which, while remaining inoperative, provides communication between the other end of the first main tube and the bell, as well as between the other end of the second main tube and the other end of the intermediate tube, and, when operated, effects communication between the other ends of the first main tube and the intermediate tube, as well as between the other end of the second main tube and the bell.

According to another aspect of this invention, there is provided a brass wind musical instrument which further comprises an auxiliary tube of a prescribed length extending along the second main tube, and a third changeover valve, which is operated jointly with the second changeover valve, and, while remaining inoperative, inserts the auxiliary tube in series into the second main tube.

DETAILED DESCRIPTION

This invention is applicable to brass wind musical instruments including a French horn, tube and euphonium. For convenience, description is given of the application of the invention to the French horn.

Figure 1:
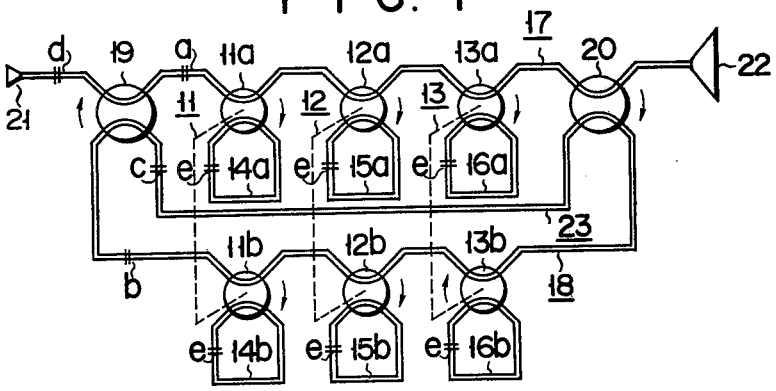
FIG. 1 schematically shows the arrangement of a brass wind musical instrument according to one embodiment of this invention.

FIG. 1 schematically illustrates the arrangement of a French horn having first to third valve assemblies 11, 12, 13 operated respectively by playing keys (not shown). These valve assemblies 11, 12, 13 are each of double construction. Namely, the first valve assembly 11 comprises a pair of jointly actuated rotary valves 11*a*, 11*b*. Similarly, the second valve assembly 12 comprises a pair of jointly operated rotary valves 12*a*, 12*b*. The third valve assembly 13 is formed of a pair of jointly operated rotary valves 13*a*, 13*b*. The valves 11*a*, 12*a*, 13*a* are disposed on a first main tube 17 having a predetermined length, such that, when operated by the depression of the respective keys, these valves allow respective bypasses 14*a*, 15*a*, 16*a* arranged along the first main tube 17 to be inserted into the first main tube 17 in series. Likewise, the valves 11*b*, 12*b*, 13*b* are disposed on a second main tube 18 having a predetermined length different from that of the first main tube 17, so that, when actuated by the operation of the respective keys, the valves 11*b*, 12*b*, 13*b* enable respective bypasses 14*b*, 15*b*, 16*b* provided along the second main tube 18 to communicate in series with the second main tube 18. Since such arrangement of the valves, main tubes and bypasses is similar to that of the ordinary French horn, further description is omitted.

FIG. 1 shows the condition of a brass wind musical instrument according to one embodiment of this invention, in which keys are not operated. Under this condition, the bypasses 14*a*, 15*a*, 16*a* are not inserted into the first main tube 17, nor are inserted the other group of bypasses 14*b*, 15*b*, 16*b* into the second main tube 18. Where, however, the first valve assembly 11, for example, is operated by depression of the corresponding key, the valves 11*a*, 11*b* are rotated in the direction of the indicated arrow, causing the bypasses 14*a*, 14*b* to be inserted in series into the first and second main tubes 17, 18 respectively, thereby increasing the length of an air column formed in the respective main tubes 17, 18 by that extent. Both ends of the first and second main tubes 17, 18 respectively lead to the corresponding first and second changeover valves 19, 20 which are also actuated by respective playing keys (not shown). The first changeover valve 19 is connected to a mouthpiece 21, and the second changeover valve 20 is connected to a bell 22. Led to both changeover valves 19, 20 are the corresponding ends of an intermediate tube 23 also having a predetermined length.

While remaining inoperative, the first changeover valve 19 ensures communication between the mouthpiece 21 and the respective end of the first main tube 17, as well as between the respective ends of both the second main tube 18 and the intermediate tube 23. When operated, the first changeover valve 19 carries out communication between the mouthpiece 21 and the respective end of second main tube 18, as well as between the respective ends of both the first main tube 17 and the intermediate tube 23.

While remaining inoperative, the second changeover valve 20 attains communication between the bell 22 and the respective end of the first main tube 17, as well as between the respective ends of both the second main tube 18 and the intermediate tube 23. When actuated, the second changeover valve 20 effects communication between the bell 22 and the respective end of the second main tube 18, as well as between respective ends of both the first main tube 17 and the intermediate tube 23.

Figure 3:
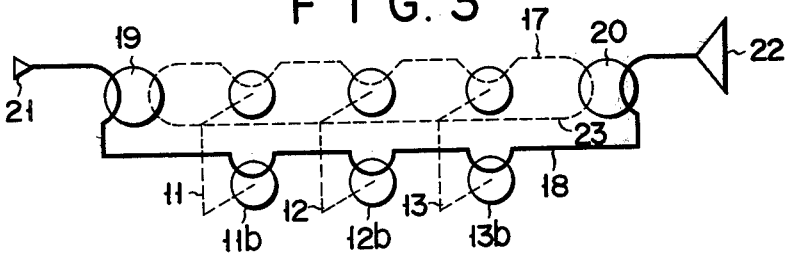
Figure 4:
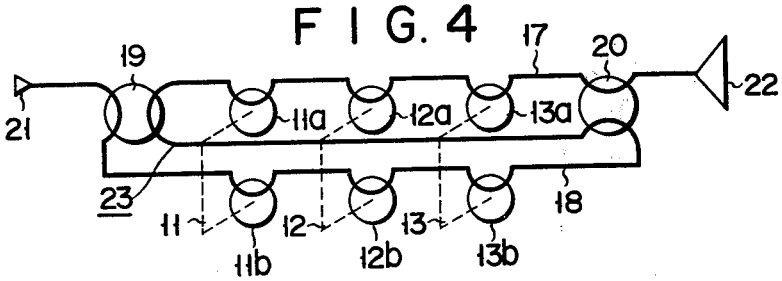
Figure 5:
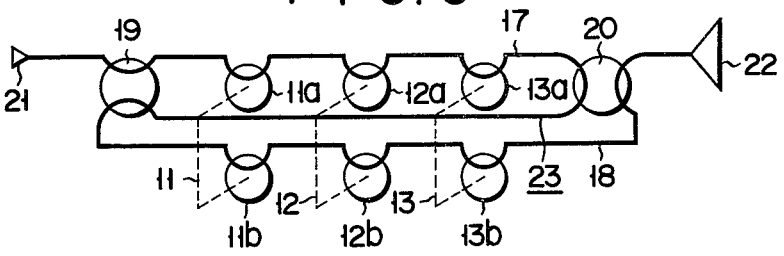

There will now be described the operation of a brass wind musical instrument according to one embodiment of this invention. When neither of the changeover valves 19, 20 is operated, communication is established between the first main tube 17 and the bell 22, thereby forming the shortest air column as indicated in a bold solid line in FIG. 2. As a result, a performance is made with a highest possible pitch range defined by the first main tube 17.

Where both changeover valves 19, 20 are actuated, communication is established between the mouthpiece 21, second main tube 18 and bell 23, thereby providing an air column as shown in a bold solid line in FIG. 3. In this case, a second highest pitch range defined by the second main tube 18 is produced due to the second main tube 18 being extended longer than the first main tube 17.

Where the first changeover valve 19 is operated and the second changeover valve 20 remains inoperative, communication is realized, as shown in FIG. 4, throughout the mouthpiece 21, second main tube 18, intermediate tube 23, first main tube 17 and bell 22, thereby providing an air column adapted to generate a largest and lowest possible pitch range obtainable with a brass wind musical instrument.

Where the first changeover valve 19 is not operated, but the second changeover valve 20 is operated, communcation arises, as shown in FIG. 5, throughout the mouthpiece 21, first main tube 17, intermediate tube 23, second main tube 18 and bell 22, providing an air column substantially as long as in FIG. 4. A player selects the arrangement of FIG. 4 or FIG. 5 according to the convenience of a performance or as he desires.

As is apparent from the foregoing description, the French horn arranged as shown in FIG. 1 enables a performance to be made with three pitch ranges or three scales, though comprising valve assemblies of double construction.

Figure 2:
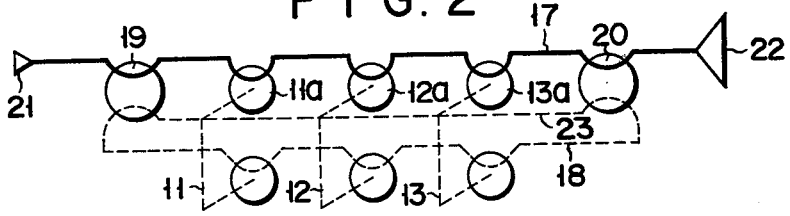
FIGS. 2 to 5 respectively illustrate the conditions of the brass wind musical instrument of FIG. 1, in which no changeover valve is used, the first and second changeover valves are operated, only the first changeover valve is used, and only the second changeover valve is actuated.

With the above-mentioned embodiment, it is advised that where the condition of FIG. 2 is adjusted to the key of B flat, the conditions of FIGS. 3 and 4 (or 5) be tuned to the key of F and G (or A flat) respectively; and that where the condition of FIG. 2 is adjusted to the key of C, then the conditions of FIGS. 3 and 4 (or 5) be tuned to the keys of F, and A flat (or A) respectively.

Where, with the brass wind musical instrument of this invention, tuning slides for fine adjustment of an air column are located at points *a*, *b*, *c* of FIG. 1, the pitches in the first main tube 19, second main tube 20 and intermediate tube 23 can be finely adjusted. Further, a tuning slide disposed at point *d* between the mouthpiece 21 and the first changeover valve 19 can finely adjust the pitch of the whole French horn.

Figure 6:
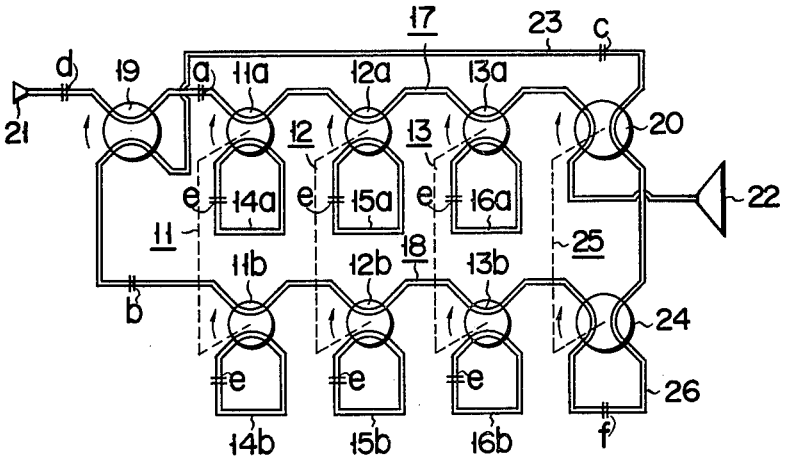
FIG. 6 schematically shows the arrangement of a brass wind musical instrument according to another embodiment of this invention.
Figure 7:
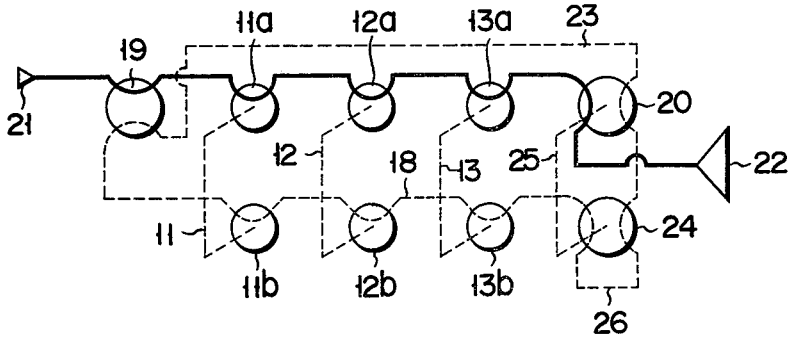
FIGS. 7 to 10 respectively illustrate the conditions of the brass wind musical instrument of FIG. 6, in which no changeover valve is used, the first, second and third changeover valves are all operated, only the second and third changeover valves are actuated; and only the first changeover valve is used.

FIG. 6 schematically indicates the arrangement of a brass wind musical instrument according to another embodiment of this invention. With this embodiment, an additional tube 26 is made to communicate in series with the second main tube 18 of FIGS. 1 to 5 with a changeover valve 24 interposed therebetween. The parts of FIG. 6 the same as those of FIGS. 1 to 5 are denoted by the same numerals, description thereof being omitted to avoid complication.

The changeover valve 24 is grouped with the changeover valve 20 to constitute a changeover valve assembly 25. Both changeover valves 20, 24 are jointly operated by one playing key (not shown).

While the changeover valve 24 remains inoperative, the additional tube 26 is inserted in series into the second main tube 18, increasing the length of the main tube 18 by that extent. When the changeover valve 24 is actuated, the additonal tube 26 is disconnected from the main tube 18, and the tube 18 is directly connected to the valve 20 through the valve 24.

There will now be described the operation of the embodiment of FIG. 6. Where neither first changeover valve 19 nor valve assembly 25 is operated, communication is established, as shown in a bold solid line in FIG.

Figure 8:
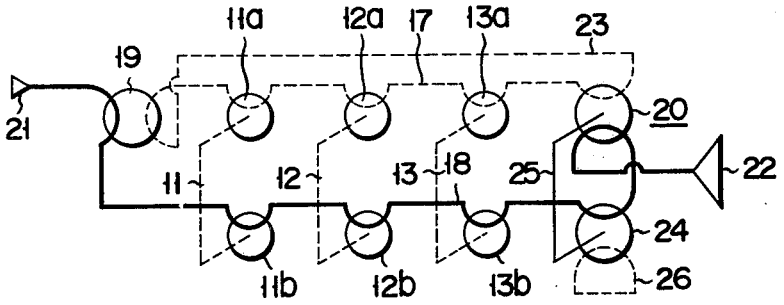

7, throughout the mouthpiece 21, first main tube 17 and bell 22, thereby forming the shortest air column.

Where both first changeover valve 19 and second changeover valve assembly 25 are actuated, communication is effected, as shown in FIG. 8, throughout the mouthpiece 21, second main tube 18 (not including the additional tube 23) and the bell 22, thereby providing a second shortest air column.

Figure 9:
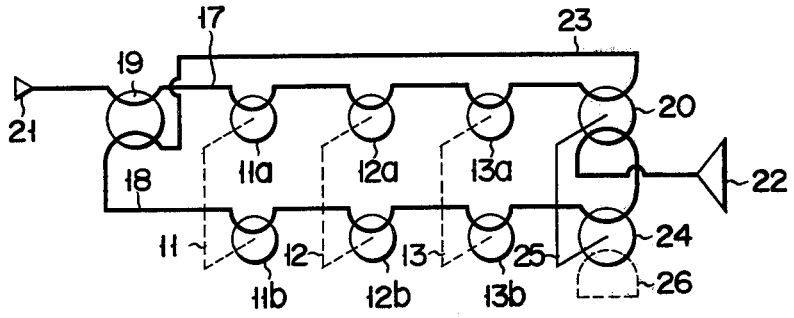
Figure 10:
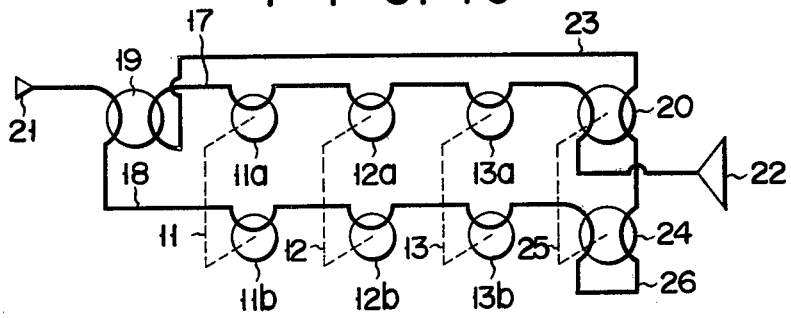

The bold solid line of FIG. 9 shows the condition of a brass wind musical instrument in which the changeover valve 19 is not operated, but the changeover valve assembly 25 is operated. In this case, communication is effected throughout the mouthpiece 21, first main tube 18, intermediate tube 23, second main tube 18 (not including the additional tube 26) and bell 22, thereby forming a third shortest air column.

Where the changeover valve 19 is operated, and the changeover valve assembly 25 is not operated, communication is attained, as shown in a bold solid line of FIG. 10, throughout the mouthpiece 21, second main tube 18 (into which the additional tube 26 is inserted in series with the changeover valve 24 disposed therebetween), intermediate tube 23, and first main tube 17, thereby forming the longest air column. The bypasses 14*a*-16*b* and the additional tube 23 are provided with a tuning slides *e* and *f* for fine pitch adjustment, respectively.

With the embodiment of FIGS. 6 to 10, the additional tube 26 is positioned at the end of that side of the second main tube 18 which faces the changeover valve 20. However, the additional tube 23 may be so disposed at any other intermediate part of the second main tube 18.

A brass wind musical instrument embodying this invention enables a performance to be made with four pitch ranges or four scales, though comprising valve assemblies of double construction. Thus, the arrangements of FIGS. 7, 8, 9 and 10 can be tuned to, for example, the *b* (discant B), *f* (discant F), B and F. As need arises, however, the brass wind musical instrument enables a performance to be made with any other pitch range.

With the arrangements of FIGS. 2, 3, 7 and 8, the first and second main tubes 17, 18 are independently used, making it possible to cause the corresponding bypasses to bear the accurately desired length ratio to the main tubes 17, 18. The arrangements of FIGS. 4, 5, 9 and 10 do not always provide accurate pitch ranges but appropriate ones. However, the use of the tuning slides *a, b, c, d, e, f* enables the instrument to be precisely tuned.

The foregoing description refers to the case where the changeover valves 19, 11*a*, 11*b*, 12*a*, 12*b*, 13*a*, 13*b*, 20, 24 were all of the rotary type. However, these changeover valves may be of the piston type.

What is claimed is:

1. A brass wind musical instrument which comprises a first main tube having a prescribed length; a second main tube having a prescribed length; a mouthpiece capable of being selectively connected to one end of the respective main tubes; a bell capable of being selectively connected to the other end of the respective main tubes; a first changeover valve which, while remaining inoperative, carries out communication between the mouthpiece and one end of the first main tube; a plurality of bypasses arranged along the respective main tubes; and a plurality of valve assemblies, which, when operated, insert the bypasses in series into the corresponding main tubes; said instrument further comprising an intermediate tube having a prescribed length; said first changeover valve further providing, while remaining inoperative, communication between the one end of the second main tube and one end of the intermediate tube, and, when operated, communication between the one end of the first main tube and the one end of the intermediate tube, as well as between the mouthpiece and the one end of the second main tube; and a second changeover valve, which, while remaining inoperative, provides communication between the other end of the first main tube and the bell, as well as between the other end of the second main tube and the other end of the intermediate tube, and, when operated, effects communication between the other ends of the first main tube and intermediate tube, as well as between the other end of the second main tube and the bell.

2. The brass wind musical instrument according to claim 1, wherein tuning slides for fine pitch adjustment are provided in the main tubes, intermediate tube and bypasses, as well as between the mouthpiece and first changeover valve.

3. The brass wind musical instrument according to claim 1, which further comprises an auxiliary tube of a prescribed length disposed along the second main tube; and a third changeover valve which is operated jointly with the second changeover valve, the third changeover valve, while remaining inoperative, inserting the auxiliary tube in series into the second main tube, and while being operative, disconnecting the auxiliary tube from the second main tube.

4. The brass wind musical instrument according to claim 3, wherein tuning slides for fine pitch adjustment are provided in the main tubes, intermediate tube, bypasses and additional tube, as well as between the mouthpiece and the first changeover valve.

5. The brass wind musical instrument according to claim 3, wherein the third changeover valve, while being operative, bypasses the auxiliary tube.

* * * * *